United States Patent [19]

Edwards

[11] Patent Number: 4,765,459

[45] Date of Patent: Aug. 23, 1988

[54] INTEGRATED KEYHOLDER/CONTAINER

[76] Inventor: Charles L. Edwards, 710 East 213th Street, Bronx, N.Y. 10467

[21] Appl. No.: 83,384

[22] Filed: Aug. 10, 1987

[51] Int. Cl.[4] ..... B65D 85/40; B65D 85/56

[52] U.S. Cl. ..... 206/38.1; 70/456 R; 206/301; 206/538; 206/540

[58] Field of Search ..... 206/37, 39, 37.1, 37.4, 206/38, 38.1, 528, 536, 537, 538, 540, 232, 301; 215/200; 70/456 R; 220/4 D, 377; D3/62

[56] References Cited

U.S. PATENT DOCUMENTS

| | | | |
|---|---|---|---|
| D. 121,541 | 7/1940 | Lipic, Jr. | 206/232 |
| D. 129,716 | 9/1941 | Trollen | 206/232 |
| D. 156,228 | 11/1949 | Gaudriot | D3/62 |
| 917,894 | 4/1909 | Pusterla | 206/38.1 |
| 2,707,552 | 5/1955 | Matthiesen | 220/4 D |
| 3,141,546 | 7/1964 | Leopoldi | 206/38.1 |
| 3,306,266 | 2/1967 | McCunney | 206/37 |
| 3,567,085 | 3/1971 | Flores | 206/538 |
| 3,949,511 | 4/1976 | Goldhaft | D3/62 |
| 4,049,165 | 9/1977 | Goldhaft | 206/38 |
| 4,393,974 | 7/1983 | Levesque | 206/38.1 |
| 4,420,076 | 12/1983 | Beveridge et al. | 206/540 |

FOREIGN PATENT DOCUMENTS

| | | | |
|---|---|---|---|
| 1067735 | 1/1954 | France | 206/537 |
| 1479473 | 3/1967 | France | 206/232 |

*Primary Examiner*—Jimmy G. Foster

*Attorney, Agent, or Firm*—Wolder, Gross & Yavner

[57] ABSTRACT

An integrated keyholder/container to facilitate carrying keys together with other important items, such as medication or a wheel lock. The unit includes a cylindrical member with a side wall terminating in an end wall to form a large receptacle. A cap removably covers a large receptacle and has an arm extending outwardly from its side wall. The arm has a bore through which a key ring passes. Another cap removably covers the end wall forming a small receptacle. The cap has a transparent end wall. The small receptacle contains a watch movement whose face is visable through the transparent end wall.

2 Claims, 1 Drawing Sheet

INTEGRATED KEYHOLDER/CONTAINER

BACKGROUND OF THE INVENTION

The present invention relates to an integrated keyholder/container, and more particularly to a unit which facilitates carrying keys together with other important items that should be kept close to the user.

Most people carry keys on a key chain or a keyholder, always having those keys on their person, or near to their person.

It is known to provide carrying receptacles in key chain holders, the receptacle being used for carrying personal items, for example. Generally, these prior structures include a key chain at one end with means to attach a single receptacle.

However, there are times when it is desired to place more than one item in a receptacle, and where these items should, by their nature, be separated from one another.

In many instances it is imperative that some people have one or more items on the person at all times. One example of such an item is a wheel lock key. Often this key is left in a house or apartment where it does no good for someone who has a flat on a remote road. If the key is left in a glove compartment, the person is defeating the purpose of the security it is suppose to provide.

For some people it is imperative to have medication for certain physical ailments always near their person. A perfect example of such a need are glycerine tablets for people with certain types of heart problems. Obviously a wheel lock key and medication should not be placed in the same compartment.

Accordingly, it is among the objects of the present invention, to provide an improved integrated keyholder/container.

Still yet another object of the present invention is to provide an improved integrated keyholder/container which may easily carry keys and may easily carry at least two different items for personal use, as required.

Still yet a further object of the present invention is to provide an integrated keyholder/container of the character described, which may also provide the user with the desired time.

Still yet a further object of the present invention is to provide a device of the character described which can provide the time, and yet not subject the watch mechanism to abuse.

Still a further object of the present invention is to provide an integrated keyholder/container, which will provide for carrying at least two different items of a personal nature, as well as providing the time.

Still yet a further object of the present invention is to provide an integrated keyholder/container, which will be simple and inexpensive to manufacture, and yet be durable to a high degree in use.

BRIEF DESCRIPTION OF THE INVENTION

The present invention is directed to an improved integrated keyholder/container which in the present preferred embodiment is capable of detachably carrying keys in a manner spaced from the side of the container. The unit consists of a cylindrical member being open at one end and having a separating wall at the other end. The open end is detachably covered by a first cap which defines a large receptacle. The separating wall is detachably covered by a second cap, which together with the separating wall forms a second receptacle.

Secured to the first cap on its side wall is an outwardly extending arm having a through bore through which a key ring passes. Secured to the key ring in the usual well-known manner is at least one key.

When the first cap is removed from the cylindrical member, the first receptacle is exposed. In the preferred embodiment this is the large receptacle. A wheel lock key for example, may be placed within this large receptacle, the cap being repositioned over the open end.

The second cap may be removed and an item, such as pills, may be placed therein, forming a small receptacle in the preferred embodiment. The cap has a transparent end wall so that the interior of the contents may be seen. A watch may also be mounted on the outer surface of the separating wall, the watch being visible through the transparent end wall of the second cap.

The above description, as well as further objects and advantages of the present invention, will be more fully appreciated with reference to the following detailed description of a preferred, but nonetheless illustrative embodiment of the invention, when taken in conjunction with the following drawings, wherein.

DETAILED DESCRIPTION OF THE INVENTION

Figure 1:
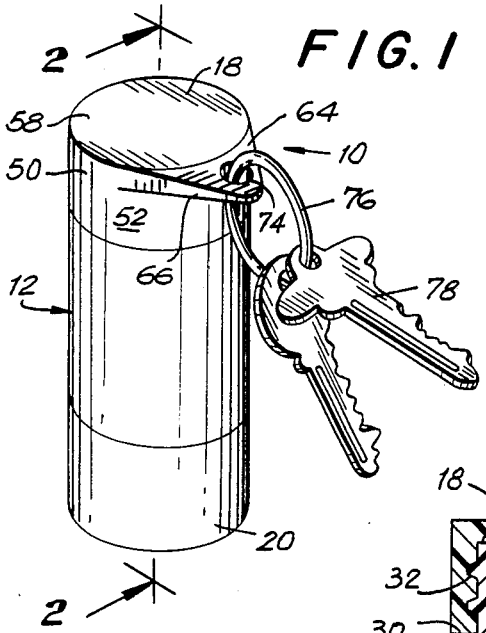
FIG. 1 is a front perspective view of an integrated keyholder/container in its closed condition.
Figure 2:
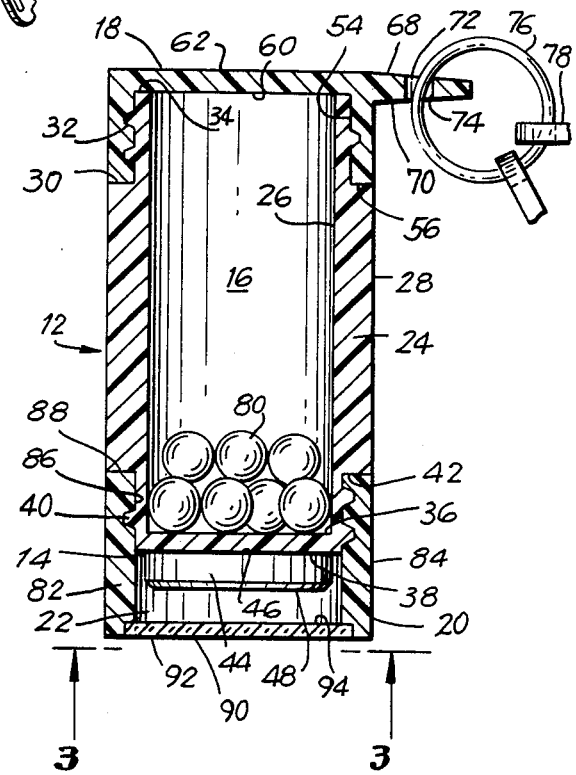
FIG. 2 is an enlarged cross-sectional view taken along the lines 2—2 of FIG. 1.

Turning in detail to the drawings, and more particularly to FIGS. 1 and 2, there is shown an integrated keyholder 10 broadly comprised of a cylindrical member 12, a separating wall 14 defining a large receptacle 16 covered by a first or large receptacle cap 18. The other end of the member is covered by a second or small receptacle cap 20 defining a second or small receptacle 22.

Turning in detail to the cylindrical member 12, it is defined by a cylindrical side wall 24 defined by an inner surface 26 and an outer surface 28. Moving towards the end away from the separating wall 14, there is an instepped annular shoulder 30 and the remaining portions of the wall formed with exterior threads 32, the wall terminating in an end surface 34.

The separating wall 14 is located at the other end of the cylindrical member and is defined by an inner surface 36 and an outer surface 38. The side wall 24 extending away from the separating wall carries exterior threads 40 terminating in an annular shoulder 42.

As shown in FIG. 2, there is a watch 44 whose back portion 46 is secured to the outer surface 38 of the separating wall 14. The watch face 48 faces outwardly and away from the unit.

The first or large receptacle cap is formed of a cylindrical side wall 50 defined by an outer surface 52 and an inner threaded surface 54 terminating inwardly at an annular end surface 56. In the other direction, the cap is terminated by an end wall 58 defined by an inner surface 60 and an outer surface 62.

Figure 5:
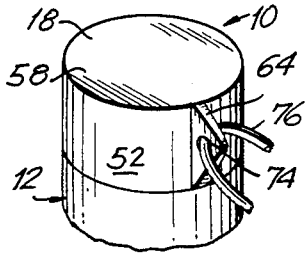
FIG. 5 is a front perspective view, partly cut away, showing the preferred embodiment of the invention.

As seen in the preferred embodiment (FIG. 5) extending outwardly from the surfaces 52, 56 and 62 is an arm 64, which is approximately triangular in shape and mates smoothly with the first cap 18. The arm is defined by a side surface 66, an upper surface 68 and a lower surface 70. As can best be seen in FIG. 2 in another embodiment, the arm is somewhat shaped like a wedge, the width narrowing the further away it gets from the cap 18. A through bore 72 is defined near the apex of the arm and has an inner surface 74 through which passes a key ring 76 in the well known manner, and which carries keys 78, again in the well known manner.

The large receptacle (FIG. 2) 16 may contain preferably a wheel lock key (not shown) or pills 80, such as glycerine. Because of the nature of the medication, it is wise that only the pills be contained in this compartment.

Referring to FIG. 2, the second or small receptacle cap 20 is defined by a cylindrical side wall 82 with an outer surface 84 and an inner threaded surface 86 terminating in an annular end surface 88. The end wall 90 may be either solid or transparent as shown. The wall has an outer surface 92 and an inner surface 94 and may be secured to the cylindrical side wall 82 in any well known fashion.

In operation with the transparent surface, the small receptacle 22 may just contain the watch so that the time is readily available, or it may contain another item such as pills. Since this is always a clean item to be protected, it is quite understandable that a separate receptacle, such as the large receptacle 16 be completely isolated especially if a dirty item like a wheel lock key is there.

Since the keys are usually always kept on the person of the user, the receptacles which are carried with the keys would also be kept on the person of the user and should problems occur with the user's heart, for example, he or she immediately has access to appropriate medication. At the same time, the small receptacle acts to provide means for the user to readily know the time of day, or it may act as a supplementary compartment to contain another item. For sanitary reasons, it is completely separated from the large receptacle.

Thus, my invention solves the problem of how to keep items it is imperative to have on one's person, proximate one's person. Keys, especially car keys, are almost always kept on one's person. And my invention allows one to keep at least two different items on one's person and in a protected manner.

My invention also contemplates a watch mechanism in a protected, yet visible fashion. This design might change the current vogue of having a wrist watch. Instead people will obtain my invention and keep track of time using the watch contained therein.

Figure 4:
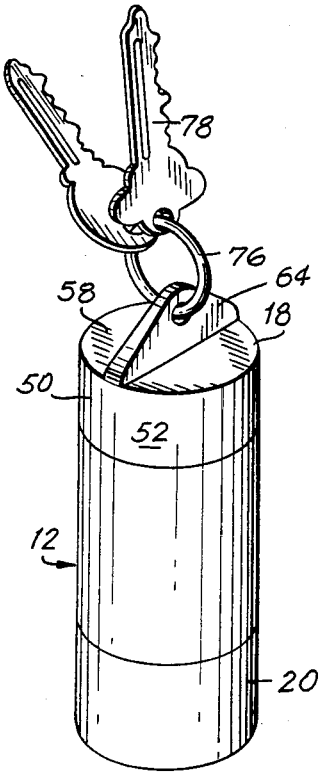
FIG. 4 is a front perspective view of a modified embodiment of the present invention.
Figure 3:
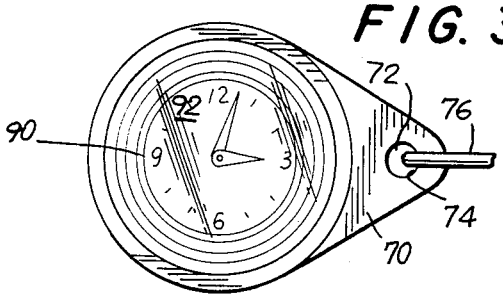
FIG. 3 is an end view taken along the lines 3—3 of FIG. 2.

Turning to FIG. 4, there is shown a modified embodiment of the invention in which all the parts are alike, except that the arm secured to the end wall 58 rather than the side wall 50 of the first or large receptacle cap 18.

Turning to FIGS. 1 and 2, there is shown another modified embodiment with the arm 164 perpendicular to the major axis of the keyholder and parallel to the plane of the end wall 58. The same numbers as used to identify the arm 64 in the preferred embodiment are also used for this embodiment.

It is also possible to have the arm 64 perpendicular to the major axis of the unit, parallel to the plane of the end wall and yet spaced from it on the side wall.

As can be seen, the present invention provides a significant advance over the state of the technology. As numberous additions, modifications and constructions can be performed within the scope of the invention, such scope is to be measured by the claims herein.

What is claimed is:

1. An improved integrated keyholder/container unit which comprises:

(a) a receptacle member having a side wall, an opening at one end of the side wall and a separating wall at the other end of the side wall forming a first receptacle;

(b) a first cap, means to removably attach the cap to a portion of the side wall proximate the open end thereof to cover the first receptacle;

(c) a second cap, means to removably attach the cap proximate the separating wall, the cap and wall forming a second receptacle;

(d) means secured to the first cap to secure at least one key to the unit; and (e) a watch secured to the surface of the separating wall, so that the face of the watch is facing in a direction away from the separating wall.

2. The invention according to claim 1, wherein the second cap includes a transparent end wall.

* * * * *